United States Patent [19]

Takahashi et al.

[11] 4,423,856

[45] Jan. 3, 1984

[54] CONTROLLED COOLING APPARATUS FOR HOT ROLLED WIRE RODS

[75] Inventors: Eiji Takahashi, Nishinomiya; Shinichi Shimazu; Yukio Wada, both of Kobe; Ichiro Iwami; Takashi Nishiwaki, both of Kakogawa; Toshikazu Nishiyama, Akashi; Yutaka Ichida, Osaka, all of Japan

[73] Assignee: Kabushiki Kaisha Kobe Seiko Sho, Kobe, Japan

[21] Appl. No.: 359,231

[22] Filed: Mar. 18, 1982

[30] Foreign Application Priority Data

Mar. 18, 1981 [JP] Japan ..... 56-41221
Mar. 18, 1981 [JP] Japan ..... 56-41222

[51] Int. Cl.[3] ..... C21D 9/573

[52] U.S. Cl. ..... 266/106; 266/111; 148/156; 72/201

[58] Field of Search ..... 266/106, 259, 111–114; 148/153, 155, 156; 72/201

[56] References Cited

U.S. PATENT DOCUMENTS 3,940,961 3/1976 Gilvar ..... 72/40
3,940,967 3/1976 Vitelli ..... 72/201
4,023,392 5/1977 Fujita et al. ..... 72/201

*Primary Examiner*—L. Dewayne Rutledge
*Assistant Examiner*—Christopher W. Brody
*Attorney, Agent, or Firm*—Oblon, Fisher, Spivak, McClelland & Maier

[57] ABSTRACT

A controlled cooling apparatus for a wire rod coiled into loops immediately after hot rolling. The coiled wire rod is transported with the loops laid substantially flat with a space of a given pitch from one another on a cooling bed. Nozzles are provided to project a cooling fluid such as forced air from below the cooling bed at an angle of from 40° to 140° with respect to the plane of the cooling bed to cool the coiled wire during its transportation. The nozzles are open in a transverse direction of the cooling bed with a nozzle opening area ratio of from 0.8 to 1.2, to provide uniform distribution of the cooling fluid in the transverse direction, whereby uniform cooling can be accomplished to minimize the variation in the cooling rates at densely overlapped loop portions and at sparsely overlapped loop portions.

2 Claims, 22 Drawing Figures

CONTROLLED COOLING APPARATUS FOR HOT ROLLED WIRE RODS

BACKGROUND OF THE INVENTION

1. Field of the Invention

The present invention relates to a controlled cooling apparatus for a wire rod coiled into loops immediately after hot rolling and being transported on a cooling bed.

2. Description of the Prior Art

It is common that a wire rod is coiled by a laying cone into loops immediately after hot rolling and transported by a conveying means on a cooling bed, with said loops laid flat thereon with a space of a predetermined pitch, and the coiled wire rod is cooled by a cooling fluid such as forced air projected from nozzles provided in the cooling bed, during its transportation. Since the rod loops are spaced from one another in a given pitch in a direction of transportation, it is inevitable that the extent of the loop overlap on the cooling bed varies from the center of the loops and both sides thereof, i.e. the rod loops overlap heavily or densely along both side portions (hereinafter referred to as "densely overlapped portion(s)" and lightly or sparsely at the center portion (hereinafter referred to as "sparsely overlapped portion"). Accordingly, it is difficult to attain uniform cooling of the entire rod loops. In practice, a greater number of nozzles are provided along both sides of the loops than at the center thereof so that the flow rate of the cooling fluid can be controlled and increased in proportion to the extent of the loop overlap. However, not only the control of the flow rate is difficult, but also a great amount of cooling fluid is required, leading to an economical disadvantage.

Further, in the conventional system, nozzles are designed to project the cooling fluid at an angle of less than 30° with respect to the cooling bed, whereby the cooling fluid stream is directed substantially parallel to the plane of the cooling bed. Thus, the direction of the cooling fluid is almost parallel to the axis of the wire rod at the densely overlapped portions, and the cooling efficiency at such portions is poor. Even if a greater number of nozzles are provided at such portions, the cooling rate still tends to be smaller at the densely overlapped portions than at the sparsely densed portion, and thus it is difficult to attain uniform cooling. The variation in the cooling rate of the wire rod leads to a variation in the mechanical properties of the wire rod thereby obtained.

Further, in a case where the conveying means comprises support rails and chain conveyors arranged in the direction of the transportation, it is inevitable that a so-called low flow rate region is formed immediately above such rails and conveyors, which adds to the variation in the cooling rate. Furthermore, in such a conveyor, hooks or fingers are in engagement with the loops of the wire rod, and uniform cooling is almost impossible at such engaging portions.

As an example of such prior art, reference is made to U.S. Pat. No. 4,023,392.

SUMMARY OF THE INVENTION

Accordingly, it is an object of the present invention to eliminate the above mentioned difficulties inherent in the conventional systems and to provide a controlled cooling apparatus which is capable of uniformly cooling the entire wire rod so as to minimize the variation in the mechanical properties of the wire rod thereby obtained.

Another object of the present invention is to provide a controlled cooling apparatus in which the angle of the projection of the cooling fluid and the flow rate distribution in the transverse direction of the cooling bed are adjusted so that same amount of the cooling fluid intermittently impinges on the wire rod, without increasing the amount of the rate of the projected cooling fluid in proportion to the overlapping density of the rod loops as in the conventional cooling systems.

A further object of the present invention is to provide a controlled cooling apparatus whereby control of the cooling rate can easily be obtained.

Namely, the present invention provides a controlled cooling apparatus for a wire rod coiled into loops immediately after hot rolling and being transported with said loops laid flat with a space of a predetermined pitch from one another on a cooling bed, comprising nozzles to project a cooling fluid from below the cooling bed to cool coiled wire rod during its transportation on the cooling bed, in which each of the nozzles is open in a transverse direction of the cooling bed with a nozzle opening area ratio of from 0.8 to 1.2. The nozzle opening area ratio used here is meant for a ratio of the nozzle opening area per unit transverse length of summation of nozzle opening at any particular position in the transverse direction to the summation of the nozzle opening area per unit transverse length of the nozzle opening at the center position in the transverse direction.

According to a preferred embodiment of the present invention, the cooling bed is provided with a roller conveyor for transporting the coiled wire rod, and each of the nozzles is disposed to project the cooling fluid at an angle of from 40° to 140° with respect to the plane of the cooling bed.

According to another preferred embodiment, the cooling bed is provided with a chain conveyor, and in addition to the nozzles open in the transverse direction, further nozzles are provided along both sides and below the chain conveyor, wherein all of the nozzles are disposed to project the cooling fluid at an angle of from 40° to 140° with respect to the plane of the cooling bed.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views and wherein:

FIG. 1(1) is a cross sectional view taken along the line I—I of FIG. 1.

FIG. 1(2) is a cross sectional view taken along the line II—II of FIG. 1.

FIG. 2(1) is a cross sectional view taken along the line I—I of FIG. 2.

FIG. 2(2) is a cross sectional view taken along the line II—II of FIG. 2.

FIGS. 3(1), (2) and (3) are cross sectional views taken along the line I—I of FIG. 3 and illustrating different nozzle arrangements.

FIGS. 7(1), (2) and (3) are cross sectional views taken along the line I—I of FIG. 7 and illustrating different nozzle arrangements.

FIG. 8(1) is a cross sectional view taken along the line I—I of FIG. 8.

FIG. 8(2) is a cross sectional view taken along the line II—II of FIG. 8.

DETAILED DESCRIPTION OF THE PREFERRED EMBODIMENTS

General aspects of the cooling systems for a coiled wire rod will be described prior to the detailed description of the present invention.

Figure 1:
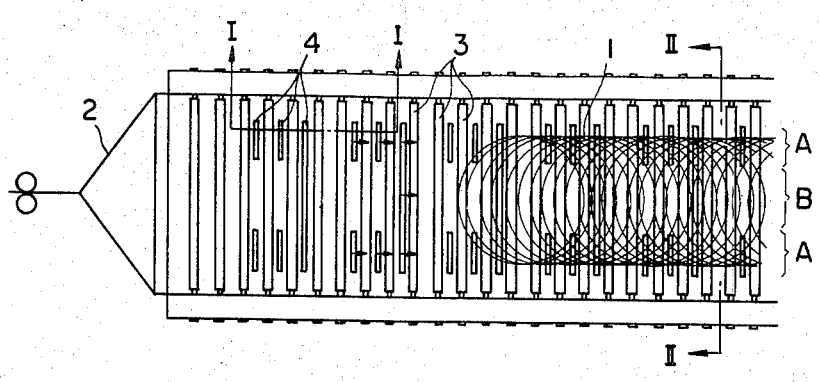
FIG. 1 is a plan view of a conventional cooling apparatus provided with a roller conveyor.
Figure 1:
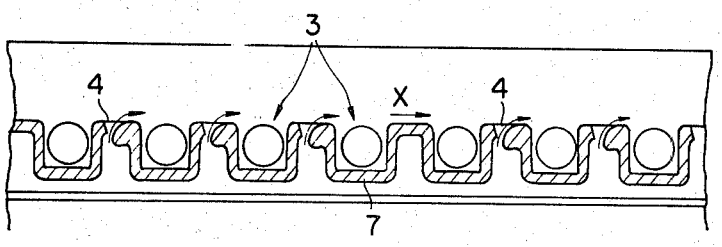
Figure 1:
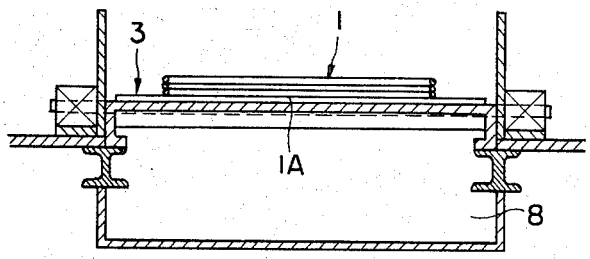
Figure 2:
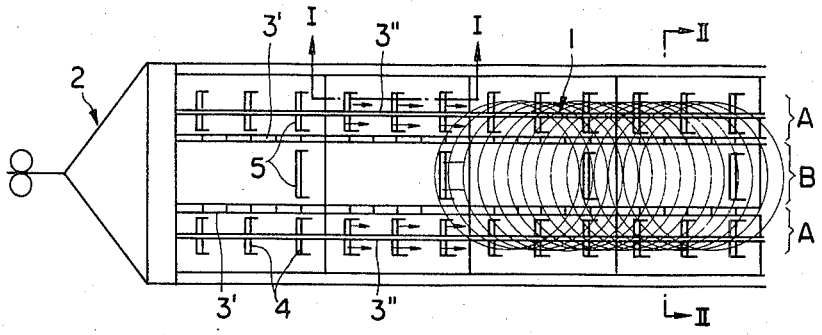
FIG. 2 is a plan view of another conventional cooling apparatus provided with chain conveyors.
Figure 2:
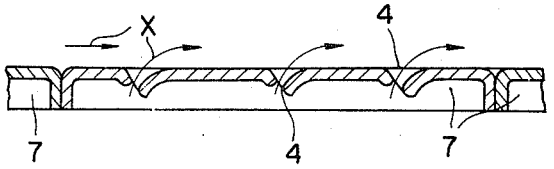
Figure 2:
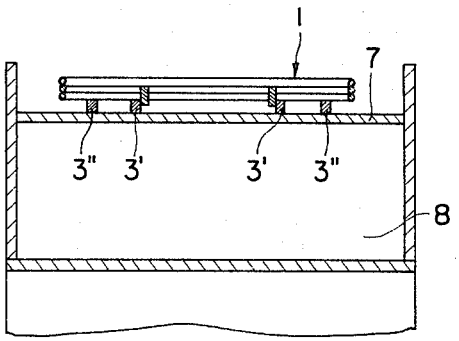

Referring to FIGS. 1 and 2, the conventional cooling systems will be described. A hot rolled wire rod 1 is, via a laying cone 2, laid on a cooling bed 7, in the form of loops spaced in a predetermined pitch from one another in the longitudinal direction of the cooling bed, and continuously transported in a predetermined direction, i.e. to the right in the illustrated cases, by a conveying means, such as a roller conveyor 3, or chain conveyors 3' and rails 3'', provided on the cooling bed 7. During its transportation, the coiled wire rod is cooled by a cooling fluid such as forced air projected from nozzles 4 provided in the cooling bed 7.

The loops of the wire rod 1 overlap one another heavily or densely along their side portions i.e. densely overlapped portions A, and lightly or sparsely at their center portion i.e. sparsely overlapped portion B. Accordingly, the cooling rate of the wire rod tends to vary between the densely overlapped portions A and the sparsely overlapped portion B.

It has been proposed to reduce the variation in the cooling rate by providing a greater number of nozzles 4 at the positions corresponding to the densely overlapped portions A than at the position corresponding to the sparsely overlapped portion B, to thereby increase the flow rate of the cooling fluid at the former positions, or by increasing the flow velocity of the cooling fluid against the densely overlapped portions A. However, such system not only requires a great amount of the cooling fluid but also makes its control very difficult.

As shown in FIGS. 1(1) and 2(1), according to the conventional systems, the nozzles 4 are designed to direct the stream of the cooling fluid parallel to the plane of the cooling bed 7, as indicated by an arrow x. Thus, the direction of the flow of the cooling fluid is parallel to the axis of the wire rod 1 at the densely overlapped portions A, and the cooling efficiency is accordingly poor at such portions. In such a construction, it is difficult to improve the cooling efficiency even if the number of nozzles is increased.

Further, in the case where the conveying means includes chain conveyors 3' and rails 3'' extending in the direction of the transportation, so called low velocity zones will necessarily be formed immediately above the conveyors and the rails, as the direction of the cooling fluid is parallel to the plane of the cooling bed 7 and coincides with the direction of the transportation. Uniform cooling of the entire wire rod can not thereby be attained because of the low velocity zones coupled with the variation in the overlapping density of the rod loops. Further, in the conveyor 4, hooks or fingers are in engagement with the coiled wire rod, and it is almost impossible to effect adequate cooling at such engaging portions. A variation in the cooling rate leads to a non-uniformity of the mechanical properties of the wire rod thereby obtained.

Now, a first embodiment of the present invention will be described with reference to FIGS. 3 and 3(1), (2) and (3).

Reference numeral 5 designates rollers of a roller conveyor for the transportation of a coiled wire rod. The coiled wire rod 1 sent from a laying cone in the form of loops spaced in a predetermined pitch from one another, is transported in the direction indicated by an arrow C, in a manner similar to the one described with respect to FIG. 1.

Numeral 6 designates nozzles for projecting cooling fluid such as forced air. A number of upwardly directed nozzles 6 are arranged respectively between the adjacent rollers 5 and each nozzle extends in a transverse direction perpendicular to the transporting direction. In the illustrated embodiment, the nozzle opening area ratio is 1. The angle of the nozzle face 6A of each nozzle is set to permit the projected fluid, i.e. the fluid from an air box 8 (see FIG. 1(2)), to be directed at an angle of from 40° to 140° with respect to the plane of the cooling bed 7. In this embodiment, the nozzle inner wall 6A is made flat so as to avoid the formation of the stream of the cooling fluid in a direction parallel to the cooling bed 7.

Figure 3:
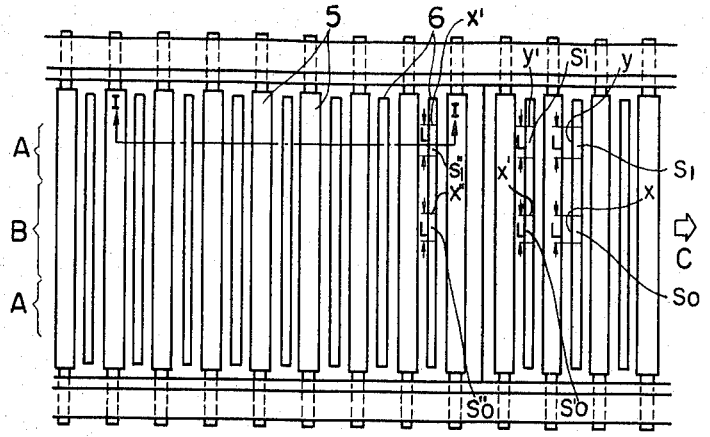
FIG. 3 is a plan view illustrating a first embodiment of the present invention.
Figure 3:
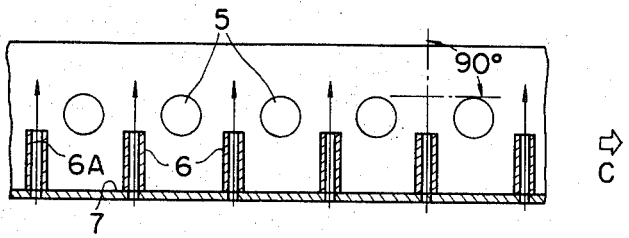
Figure 3:
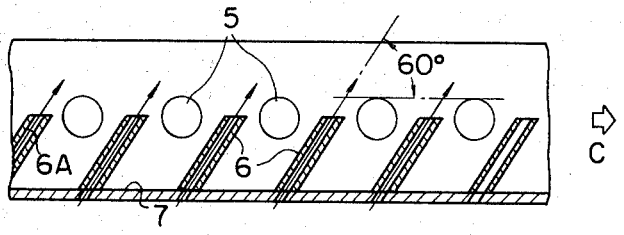
Figure 3:
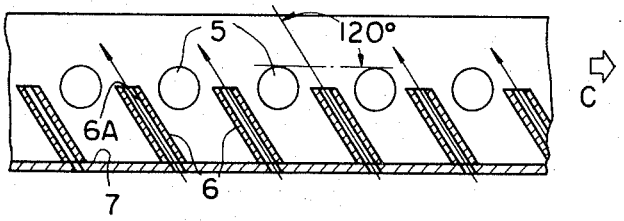

FIGS. 3(1), (2) and (3) show different cross sectional views taken along the line I—I of FIG. 3. FIG. 3(1) illustrates a vertically blowing type with an upward angle of 90°, and FIGS. 3(2) and (3) illustrate obliquely blowing types having an upward angle of 60° and 120°, respectively.

The locations of the openings of the nozzles, the number of the nozzles and the width of the openings of the nozzles at the densely overlapped portions A and at the sparsely overlapped portion B may be varied within a range of the nozzle opening area ratio being from 0.8 to 1.2. Further, the cooling fluid may be projected in the same direction at the densely overlapped portions A and the sparsely overlapped portion B, or in different directions at such portions within an upward angle range of from 40° to 140°.

Namely, the nozzles are designed to blow the cooling fluid upwardly at an angle of from 40° to 140° relative to the plane of the cooling bed so as to avoid the formation of the cooling fluid stream parallel to the cooling bed provided with rollers 5 of the roller conveyor, and at the same time to have a nozzle opening area ratio of from 0.8 to 1.2 at each position along the transverse direction of the cooling bed.

According to the conventional apparatus provided with a roller conveyor 3 as shown in FIG. 1, the wire rod 1 is cooled by a parallel flow of the cooling fluid relative to the plane of the cooling bed, and accordingly the stream of the cooling fluid is directed in the transporting direction of the coiled wire rod 1. Thus, the direction x of the fluid is parallel to the plane 1A of the loops of the wire rod 1 as shown in FIGS. 1(1) and (2). Accordingly, the fluid impinges on the sparsely overlapped portion B of the coiled wire rod 1 at an angle almost perpendicular to the axis of the wire rod 1, while it flows parallel to the axis of the wire rod at the densely overlapped portion A. The parallel flow of the cooling fluid relative to the wire rod is disadvantageous from the standpoint of the heat transfer, since the cooling efficiency is therefore extremely poor. Besides, the cooling efficiency becomes locally poor particularly at such densely overlapped portions A, thus leading to the degradation of the tensile strength of the wire rod at the densely overlapped portions A.

Whereas, according to the first embodiment of the present invention, the cooling fluid is blown upwardly at an angle of from 40° to 140°, whereby the cooling fluid impinges on the wire rod at an angle substantially perpendicular thereto at any position along the transverse direction of the cooling bed. Thus, it is possible to efficiently and uniformly cool the wire rod.

Figure 4:
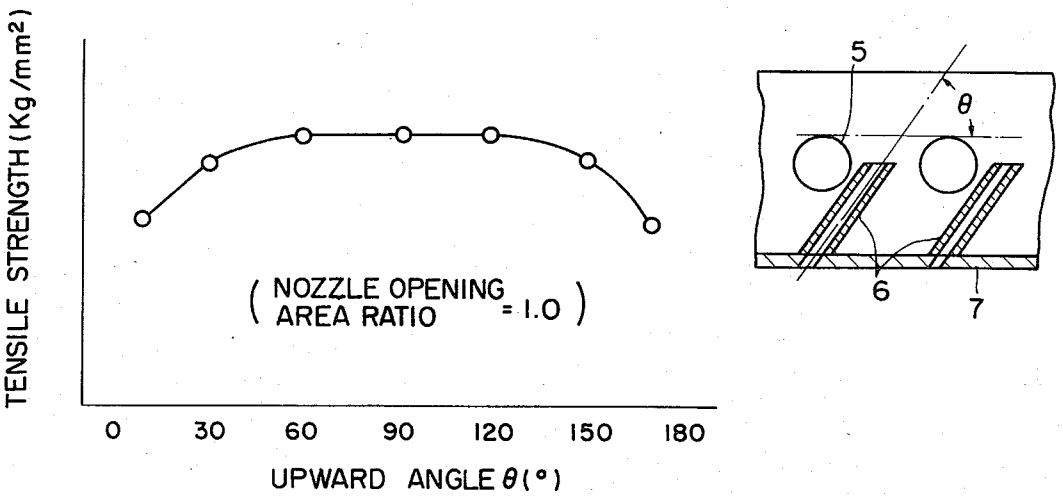
FIG. 4 is a graph showing a relationship between the upward angle of the projected cooling fluid and the tensile strength.

FIG. 4 shows the tensile strength obtained at various levels of the upward angle, i.e. the angle of the projection of the cooling fluid relative to the plane of the cooling bed. It will be seen that good tensile strength is obtainable within a range of the upward angle of from 40° to 140°. If the upward angle is less than 40° or more than 140°, the flow of the cooling fluid tends to be a parallel flow cooling mode and the flow distance from the cooling bed to the impinging point on the wire rod tends to be long, thus leading to a decrease of the flow velocity and giving rise to an overall decrease of the tensile strength. The upward angle is preferably from 60° to 120°.

The cooling fluid is blown to the coiled wire rod at an angle close to perpendicular to the plane of the loops, and the cooling efficiency at the densely overlapped portions A is thereby substantially improved, and it will be unnecessary to supply a greater amount of forced air to the densely overlapped portions as was the case in the conventional system. Namely, by disposing the nozzles 6 so as to blow the same amount of the cooling fluid against the coiled wire rod at each position in the transverse direction of the cooling bed, it is possible to uniformly cool the wire rod irrespective of the degree of the loop overlap.

Figure 5:
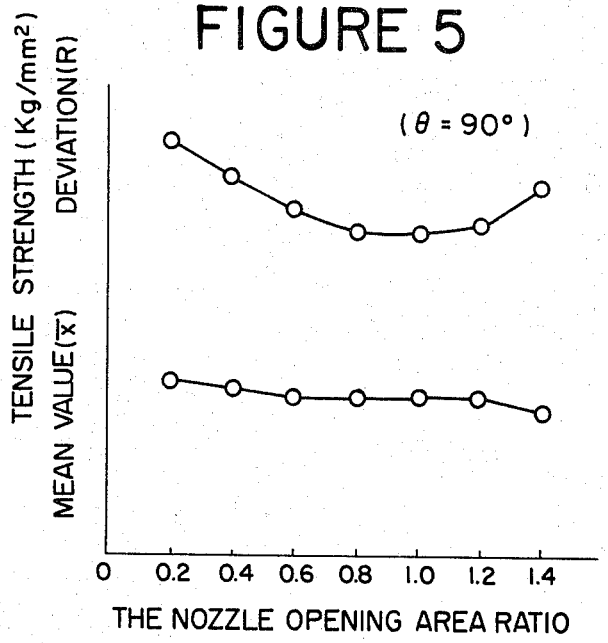
FIG. 5 is a graph showing a relationship between the nozzle opening area ratio and the tensile strength.

FIG. 5 shows the average values and the variations of the tensile strength at various levels of the nozzle opening area ratio. It will be seen that the tensile strength variations are minimized within a range of the nozzle opening area ratio of from 0.8 to 1.2. If the nozzle opening area ratio is less than 0.8 or more than 1.2, the variation in the cooling rates at the densely overlapped portions and at the sparsely overlapped portion tends to be greater and consequently the variation in the tensile strength of the wire rod becomes greater.

Referring to FIG. 3, the nozzle opening area ratio is a ratio of summation of the nozzle opening area $S_1$ per unit transverse length of the nozzle opening at any particular position in the transverse direction to the summation of the nozzle opening area $S_0$ per unit transverse length of the nozzle opening at the center position in the transverse direction. Namely, it is represented by the following formula:

$$\text{Nozzle opening area ratio } \Sigma S_0/\Sigma_1 = \Sigma xL/\Sigma yL.$$

where, $S_0$: Nozzle opening area at the center position in the transverse direction of the cooling bed, $S_1$: Nozzle opening area at any given position in the transverse direction of the cooling bed, L: Unit transverse length of the nozzle opening, x: Width of the nozzle opening at the center position, and y: Width of the nozzle opening at the given position.

Now, an example of the first embodiment of the present invention will be described.

With use of a high carbon steel wire rod (SWRH72B, 5.5 mm in diameter), an experiment was made to compare the tensile strength distributions at various positions in the transverse direction of the cooling bed as well as the variation levels in the tensile strength with respect to the conventional cooling system A (the upward angle: 0° to 30°, and the nozzle opening area ratio: 0.33), a comparative cooling system B (the upward angle: 90°, and the nozzle opening area ratio: 0.33) and a cooling system C according to the present invention. The tensile strength distributions are shown in FIG. 6, and the variation levels in the tensile strength are listed in the following Table 1.

TABLE 1

| | Upward angles $\theta$° | Nozzle opening area ratios | Tensile strength within one coil Kg/mm$^2$ $\bar{x}$ (average) | $\sigma_c$ (standard deviation) | $R_c$ (ranges of variations) |
|---|---|---|---|---|---|
| Conventional system (A) | 0 ~ 30 | 0.33 | 111.3 | 1.84 | 9.2 |
| Comparative system (B) | 90 | 0.33 | 113.2 | 1.53 | 7.5 |
| Present invention (C) | 90 | 1.00 | 112.5 | 0.89 | 4.9 |

Figure 6:
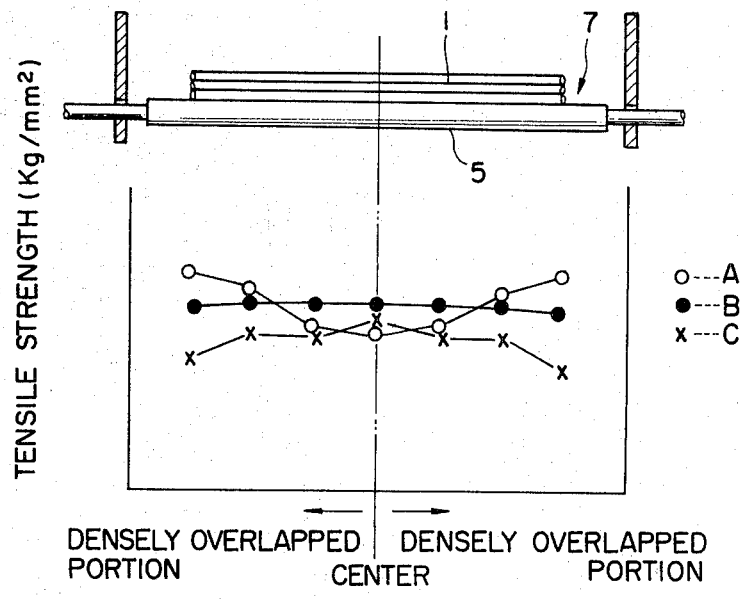
FIG. 6 is a graph showing the tensile strength distributions obtainable by the first embodiment of the present invention, a comparative cooling system and the conventional cooling system shown in FIG. 1.

It is apparent from FIG. 6 and Table 1 that according to the conventional system A, the cooling efficiency is poor as the upward angle is small, and the overall tensile strength is low, and further overall variation is great since there exist certain parts in the densely overlapped portions where the tensile strength is extremely low. According to the comparative system B, the cooling rate or the tensile strength can be made uniform as compared with the conventional method A. However, it is seen that the tensile strength is even higher at the densely overlapped portions than other portions of the loop whereas, according to the present invention C, the cooling can be done uniformly along the transverse direction of the cooling bed, whereby the tensile strength variation is substantially minimized as compared with the conventional and comparative systems.

Figure 7:
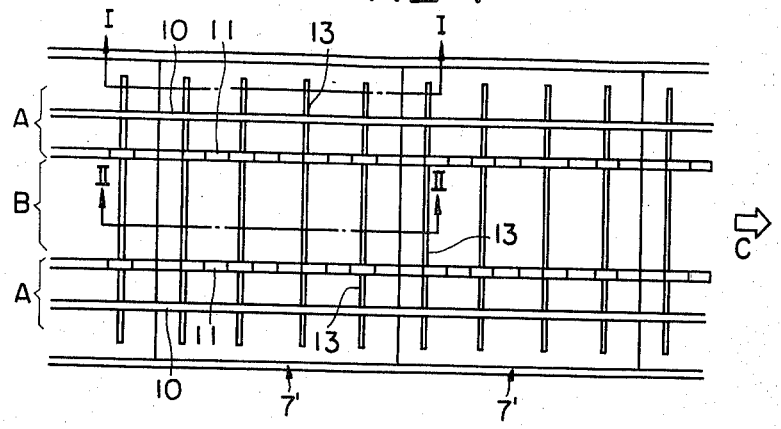
FIG. 7 is a plan view illustrating a second embodiment of the present invention.
Figure 7:
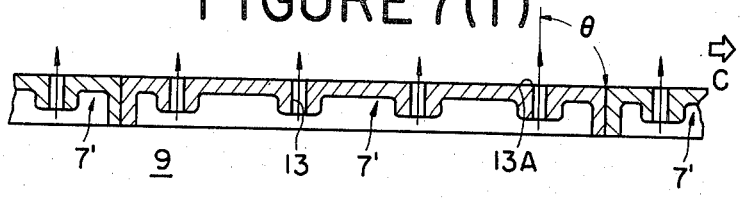
Figure 7:
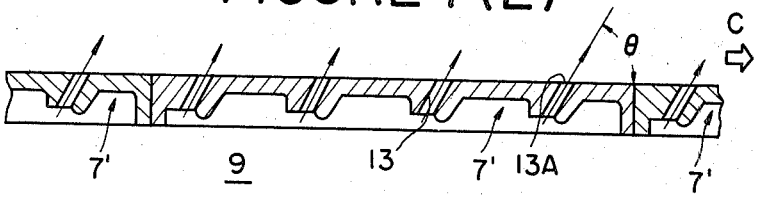
Figure 7:
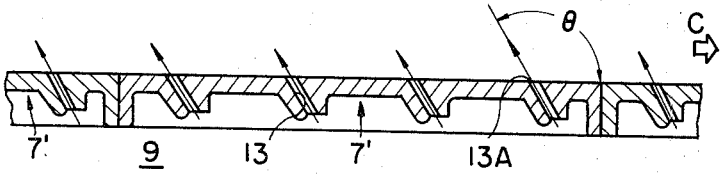

Now, referring to FIGS. 7, 7(1) to (3), 8 and 8(1) and (2) a second embodiment of the present invention will be described reference numeral 7' designates a cooling bed, and a plurality of cooling beds 7' are detachably mounted on an air box 9. Rails 10 are integrally formed on the cooling beds 7', and they are arranged linearly and parallel with the transportation direction C in the illustrated embodiment.

Figure 8:
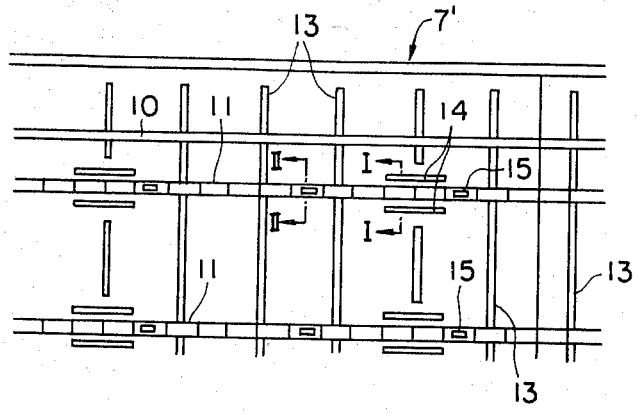
FIG. 8 is an enlarged plan view illustrating the main part of the second embodiment of the present invention.
Figure 8:
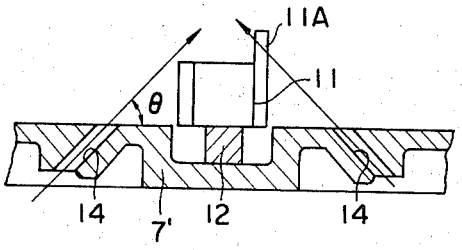
Figure 8:
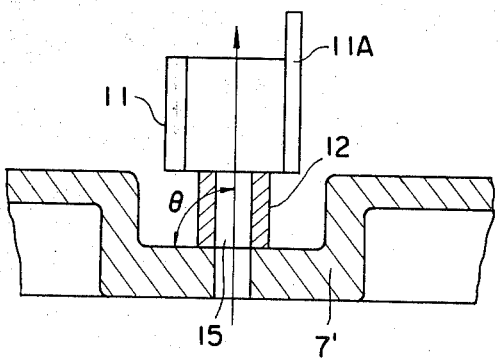

Reference numeral 11 designates chain conveyors which extend parallel with and inside of the respective rails 10 and sit on chain stands 12, as shown in FIG. 8(2). The chain conveyors are provided with fingers 11A which hook the loops (not shown) of the coiled wire rod laid on the rails 10 for transporting the coiled wire in the transportation direction C.

In the cooling beds 8, a number of nozzles are provided which respectively extend in a transverse direction and are adapted to blow out cooling fluid substantially uniformly along the transverse direction, and which at the same time are spaced for a predetermined distance from one another in the transporting direction C. The nozzles are designed to blow out the cooling fluid at an upward angle of from 40° to 140° with respect to the plane of the cooling bed, and at the same time, the nozzle face 13A is flush with the upper surface of the cooling beds to avoid the formation of the cooling fluid stream in parallel to the plane of the cooling beds.

The nozzles 13 have a length covering the densely overlapped portions A and the sparsely overlapped portion B. The nozzles illustrated in FIG. 7(1) are a so-called vertically blowing type with an upward angle of 90°, while those illustrated in FIGS. 7(2) and (3) are a so-called obliquely blowing type with an upward angle of 60° and 120°, respectively.

Thus, the nozzle arrangement is simplified to permit the flowing rate of the cooling fluid to be constant. The portion corresponding to the sparsely overlapped portion B, i.e. the cross-section along line II—II of FIG. 7, may be the same as the portion corresponding to the densely overlapped portion A. Further, the positions, the number and the opening width of the nozzles may be varied within a range where the nozzle opening areas are the same.

Further, the projecting directions of the cooling fluid at the densely overlapped portion A and the sparsely overlapped portion may be the same or different so long as they are within a range of the upward angle $\theta$ of from 40° to 140°.

FIG. 8 illustrates a specific construction wherein the same amount of the cooling fluid impinges on the coiled wire rod at each position in the transverse direction of the cooling beds 7'. Namely, taking it into account that the flow rate of the cooling fluid will be slowed down immediately above the rails 10 and the chain conveyor 11 insofar as they themselves constitute a hindrance, deflection nozzles 14 are provided at both sides of each chain conveyor 11 and at the same time, a nozzle 15 is provided in the chain stand 12. The upward angle of these nozzles 14 and 15 are likewise set within a range of from 40° to 140°.

Namely, according to this embodiment, the upward angle of the projected cooling fluid relative to the plane of the cooling bed is set within a range of from 40° to 140° thereby avoiding the formation of the parallel flow of the cooling fluid relative to the plane of the cooling bed, and at the same time, there are provided nozzles 14 and 15 immediately below and on both sides of the chain conveyors as well as the nozzles 13 extending in the transverse direction of the cooling beds.

Having thus arranged the nozzles 13, 14 and 15 to blow out the cooling fluid at an upward angle $\theta$ of from 40° to 140°, it is possible to permit the cooling fluid to impinge on the coiled wire rod at an angle substantially perpendicular thereto at any position in the transverse direction of the cooling bed, whereby cooling can efficiently be accomplished.

Figure 9:
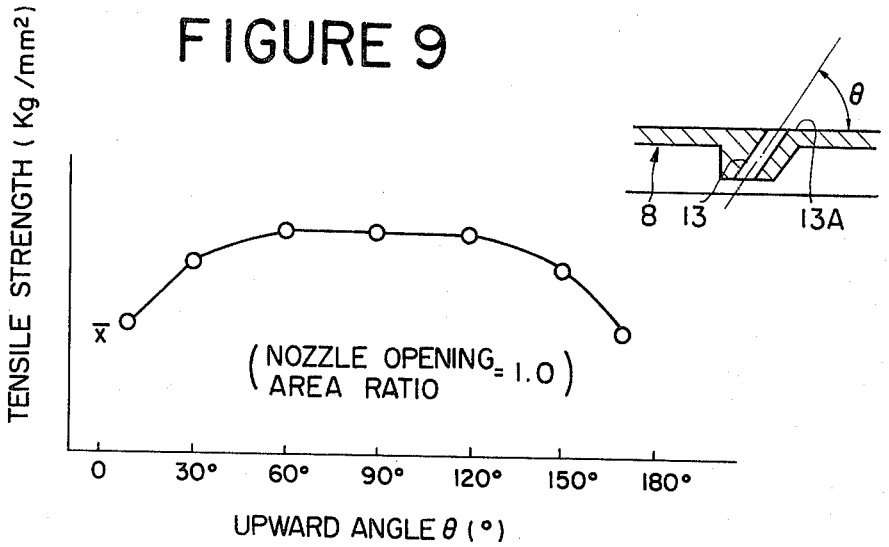
FIG. 9 shows a relationship similar to the one shown in FIG. 4, but that obtainable by the second embodiment.

As shown in FIG. 9, good tensile strength is obtainable at the upward angle within a range of from 40° to 140°. If the upward angle is less than 40° or more than 140°, the cooling fluid tends to be a parallel flow cooling mode and the flow distance from the surface of the cooling bed to the impinging point on the coiled wire rod tends to be long, thus leading to a decrease in the flow velocity and a decrease in the tensile strength.

Thus, by blowing the cooling fluid against the coiled wire rod at an angle substantially perpendicular to the plane of rod loops, the cooling efficiency at the densely overlapped positions A is substantially improved and it will be unnecessary to supply a greater amount of cooling fluid at such portions A as was the case in the conventional system.

As shown in FIG. 5, the variation in the tensile strength can be minimized by setting the nozzle opening area ratio within a range of from 0.8 to 1.2 in the same manner as in the first embodiment. If the nozzle opening area ratio is less than 0.8 or greater than 1.2, the variation in the cooling rates at the densely overlapped portion A and the sparsely overlapped portion tends to increase, thus leading to an increase in variation of the tensile strength.

Namely, the nozzles 13, 14 and 15 are arranged to permit the same amount of the cooling fluid to impinge on the coiled wire rod at any position in the transverse direction of the cooling bed, whereby uniform cooling can be attained irrespective of the density of the loop overlap. The nozzles 15 and the deflection nozzles 14 are provided to attain uniform cooling at the low flow rate portions immediately above the chain conveyors. Now, an example of this second embodiment of the present invention will be described.

With use of a high carbon steel wire rod (SWRH72A, 5.5 mm in diameter) an experiment was conducted to compare the tensile strength distributions at various positions in the transverse direction of the cooling beds with respect to the conventional system A, a comparative system B where the nozzle arrangement was the same as in the conventional method A and the upward angle was set at 90°, and the present invention C. The results thereby obtained are shown in FIG. 10.

Figure 10:
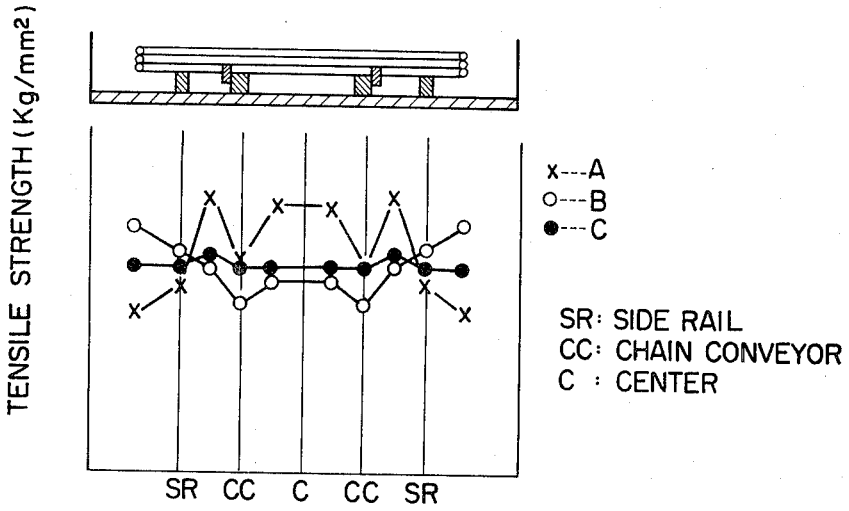
FIG. 10 is a graph showing the tensile strength distributions obtainable by the second embodiment of the present invention, a comparative cooling system and the conventional cooling system illustrated in FIG. 2.

It is apparent from FIG. 10 that in the conventional system A, the tensile strength is extremely low at the densely overlapped portions located outside the rails and at the portions located immediately above the chain conveyors, and the overall variation in the tensile strength is therefore great. According to the comparative system B, the cooling rate can be made uniform as compared with the conventional system A, but the tensile strength is even higher at the densely overlapped portions than at other portions, and is low at the portions located immediately above the chain conveyors whereas according to the present invention, uniform cooling can be done over the entire width in the transverse direction of the cooling bed.

In the following Table 2, average values $\overline{x}$, standard deviations $\sigma_c$, variation ranges Rc of the tensile strength are shown.

TABLE 2

| | Upward angles (°) | Nozzle Opening Area Ratio | Flow rates | Tensile strength within a coil of the wire rod (Kg/mm²) $\bar{x}$ | $\sigma_c$ | $R_c$ |
|---|---|---|---|---|---|---|
| Conventional system (A) | 0–30 | 0.33 | Greater at the densely overlapped portions | 108.8 | 2.24 | 12.1 |
| Comparative system (B) | 90 | 0.33 | same as above | 108.0 | 1.78 | 9.2 |
| Present Invention (C) | 90 | 1.0 | Uniformly distributed | 107.5 | 0.95 | 6.3 |

As shown in Table 2, according to the present invention, the variation in tensile strength can be minimized.

Having thus described the present invention, it should be understood that according to the present invention, it is possible to uniformly cool the entire wire rod in the form of loops immediately after the hot rolling and to thereby minimize the variation in its mechanical properties by simply improving the structure and arrangement of the nozzles for blowing the cooling fluid.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A controlled cooling apparatus for a wire rod coiled into loops immediately after hot rolling and being transported with said loops laid flat with a space of a predetermined pitch from one another on a cooling bed provided with a conveying means, comprising:

a plurality of nozzles for projecting cooling fluid from below the cooling bed to cool the coiled wire rod during transportation thereof wherein each of said nozzles is open in a transverse direction of the cooling bed with a nozzle opening area ratio of from 0.8 to 1.2, and wherein each of said nozzles is disposed for projecting the cooling fluid at an angle of from 60° to 120° with respect to the plane of the cooling bed.

2. The controlled cooling apparatus as claimed in claim 1 wherein said conveying means comprises a chain conveyor, and an additional plurality of nozzles disposed along opposite sides and below the chain conveyor for projecting the cooling fluid at an angle of from 60° to 120° with respect to the plane of the cooling bed.

* * * * *

UNITED STATES PATENT AND TRADEMARK OFFICE

CERTIFICATE OF CORRECTION

PATENT NO. 4,423,856

DATED January 3, 1984

INVENTOR(S) Eiji Takahashi et al.

It is certified that error appears in the above—identified patent and that said Letters Patent is hereby corrected as shown below:

Figure 3, (sheet 3 of 8), change "3(4)" to --3(3)--.

Column 6, lines 65-66, after "described" insert a period, also change "reference" to --Reference--, and make these two paragraphs one.

Column 8, lines 41-42, Patent only these two paragraphs should be one.

Signed and Sealed this

*Twenty-sixth* Day of *June 1984*

[SEAL]

*Attest:*

GERALD J. MOSSINGHOFF

*Attesting Officer*

*Commissioner of Patents and Trademarks*